US010814463B2

(12) United States Patent
DiMartino et al.

(10) Patent No.: US 10,814,463 B2
(45) Date of Patent: Oct. 27, 2020

(54) HELMET TOOL

(71) Applicants: William D. DiMartino, New Bern, NC (US); Edward L. Metzger, Moseley, VA (US)

(72) Inventors: William D. DiMartino, New Bern, NC (US); Edward L. Metzger, Moseley, VA (US)

( * ) Notice: Subject to any disclaimer, the term of this patent is extended or adjusted under 35 U.S.C. 154(b) by 66 days.

(21) Appl. No.: 16/186,951

(22) Filed: Nov. 12, 2018

(65) Prior Publication Data

US 2019/0143496 A1 May 16, 2019

Related U.S. Application Data

(60) Provisional application No. 62/585,669, filed on Nov. 14, 2017.

(51) Int. Cl.

| | |
|---|---|
| ***B25B 27/14*** | (2006.01) |
| ***B25B 23/00*** | (2006.01) |
| ***B25B 15/00*** | (2006.01) |
| ***B25F 1/00*** | (2006.01) |
| ***B25B 27/04*** | (2006.01) |
| ***B25B 13/06*** | (2006.01) |
| ***B25F 1/02*** | (2006.01) |
| *A42B 3/32* | (2006.01) |
| *B25G 1/08* | (2006.01) |
| *A42B 3/08* | (2006.01) |
| *A42B 3/20* | (2006.01) |

(52) U.S. Cl.

CPC ..... *B25B 27/14* (2013.01); *B25B 13/06* (2013.01); *B25B 15/005* (2013.01); *B25B 23/0035* (2013.01); *B25B 27/04* (2013.01); *B25F 1/00* (2013.01); *B25F 1/02* (2013.01); *A42B 3/08* (2013.01); *A42B 3/20* (2013.01); *A42B 3/328* (2013.01); *B25G 1/085* (2013.01)

(58) Field of Classification Search

CPC ..... B25B 27/14; B25B 27/04; B25B 13/06; B25B 23/0035; B25B 15/005; B25F 1/02; B25F 1/00; A42B 3/328; A42B 3/08; A42B 3/20; B25G 1/085

See application file for complete search history.

(56) References Cited

U.S. PATENT DOCUMENTS

| | | | | |
|---|---|---|---|---|
| 3,274,613 A * | 9/1966 | Sowle | A42B 3/20 | 2/9 |
| 7,328,462 B1 * | 2/2008 | Straus | A42B 3/067 | 2/411 |
| 7,382,462 B2 * | 6/2008 | Matsumoto | G01N 21/4738 | 356/445 |
| 9,681,698 B2 * | 6/2017 | Tatomir | A42B 3/04 | |

* cited by examiner

*Primary Examiner* — John C Hong

(74) *Attorney, Agent, or Firm* — Ward and Smith, P.A.; Ryan K. Simmons

(57) ABSTRACT

A helmet tool including a housing; a pin at least partially disposed in the housing; a trigger mechanism operatively engaged with the pin, wherein the pin and trigger mechanism may be configured together within the housing such that actuation of the trigger mechanism causes the pin to one of extend from or retract into the housing; and a latch connected to the housing.

13 Claims, 9 Drawing Sheets

HELMET TOOL

RELATED APPLICATIONS

This application claims priority to and incorporates herein by reference related U.S. Provisional Patent Application No. 62/585,669 filed on Nov. 14, 2017.

TECHNICAL FIELD

The presently disclosed subject matter relates generally to a helmet tool, and more particularly to a helmet tool for quick installation or removal of a facemask and/or chin strap of a helmet, such as a football helmet.

BACKGROUND

Existing football helmets require separate tools for various operations, such as installing/removing a facemask and installing/removing a chin strap. The existing tools further require multiple orientations to be employed by the user during installation or removal of a facemask and/or a chin strap. This can slow and make more difficult removing and/or installing components of the football helmet, such as the facemask, where time can be critical, for example, when a player is injured and the facemask needs to be quickly removed. Further, in the normal maintenance of a football helmet the facemask and other components, such as the chin strap, need to be removed for repair, painting, replacement, and/or other maintenance/upkeep issues.

Therefore, there is a need for a single tool that allows for quicker and easier installation and removal of components of a football helmets, such as facemasks and chin straps.

SUMMARY

In one embodiment, a helmet tool is provided. The helmet tool may include a housing; a pin at least partially disposed in the housing; a trigger mechanism operatively engaged with the pin, wherein the pin and trigger mechanism are configured together within the housing such that actuation of the trigger mechanism causes the pin to one of extend from or retract into the housing; and a latch connected to the housing. The helmet tool may further include a trigger lock configured such that when engaged it locks the trigger mechanism in one of an actuated or unactuated state. The helmet tool may further include a compression spring operatively engaged with the pin and trigger mechanism, wherein the pin, compression spring, and trigger mechanism are configured within the housing to cause the pin to one of extend from or retract into the housing upon actuating the trigger mechanism. The pin, compression spring, and trigger mechanism may be configured to cause the pin to extend from the housing upon actuation of the trigger mechanism and to retract into the housing when the trigger mechanism is unactuated. The pin, compression spring, and trigger mechanism may be configured to cause the pin to retract into the housing upon actuation of the trigger mechanism and to extend from the housing when the trigger mechanism is unactuated. The latch may be moveably connected to an exterior portion of the housing. The latch may be substantially L shaped and may be configured to engage with a facemask clamp of a helmet. The latch may be adjustable in length. An end portion of the pin may be configured to engage with a quick release pin of a facemask clamp of a helmet. The helmet tool may further include a chin strap nut driver integrated in the housing. The housing may have a generally cylindrical shape or pistol shape. The helmet tool may further include a socket formed in about a center portion of the chin strap nut driver and a drive bit removably attached to the housing, wherein a portion of the drive bit may be configured to be received by the socket.

In another embodiment, a method of installing a facemask to a helmet is provided. The method may include aligning holes of a facemask clamp with a corresponding helmet mating hole; inserting a facemask clamp quick release pin into the holes of the facemask clamp and into the corresponding helmet mating hole; securing the quick release pin in place using a helmet tool; and repeating for each facemask clamp to be installed. The helmet tool may include a housing; a pin at least partially disposed in the housing; a trigger mechanism operatively engaged with the pin, wherein the pin and trigger mechanism are configured together within the housing such that actuation of the trigger mechanism causes the pin to one of extend from or retract into the housing; and a latch connected to the housing. The helmet tool may further include a compression spring operatively engaged with the pin and trigger mechanism, wherein the pin, compression spring, and trigger mechanism may be configured within the housing to cause the pin to one of extend from or retract into the housing upon actuating the trigger mechanism. The helmet tool may further include a chin strap nut driver integrated in the housing; a socket formed in about a center portion of the chin strap nut driver; and a drive bit removably attached to the housing, wherein a portion of the drive bit may be configured to be received by the socket. The securing of the quick release pin in place using the helmet tool, may include extending the pin of the helmet tool; inserting the pin of the helmet tool into a center top recess of the quick release pin; pressing the helmet tool against the quick release pin, with the pin inserted in the center top recess thereof, to seat the quick release pin in the corresponding helmet mating hole; retracting the pin of the helmet tool; and pressing the helmet tool, with the pin retracted, against the quick release pin to secure the quick release pin in place.

In yet another embodiment, a method of removing a facemask from a helmet is provided. The method may include engaging a helmet tool with a quick release pin of a facemask clamp; actuating the helmet tool to release the quick release pin; removing the quick release pin from the helmet; and repeating for each facemask clamp. The helmet tool may include a housing; a pin at least partially disposed in the housing; a trigger mechanism operatively engaged with the pin, wherein the pin and trigger mechanism may be configured together within the housing such that actuation of the trigger mechanism causes the pin to one of extend from or retract into the housing; and a latch connected to the housing. The helmet tool may further include a compression spring operatively engaged with the pin and trigger mechanism, wherein the pin, compression spring, and trigger mechanism may be configured within the housing to cause the pin to one of extend from or retract into the housing upon actuating the trigger mechanism. The helmet tool may further include a chin strap nut driver integrated in the housing; a socket formed in about a center portion of the chin strap nut driver; and a drive bit removably attached to the housing, wherein a portion of the drive bit may be configured to be received by the socket. The method may further include deploying the latch from a stowed position; actuating the trigger mechanism to extend the pin; inserting the extended pin into a center top recess the quick release pin of the facemask clamp and exerting a force thereon, thereby un-securing the quick release pin from a corresponding mating hole in the helmet; engaging the latch with an underside portion of the facemask clamp; and pulling directly away from a top of the quick release pin, thereby removing the quick release pin out of the corresponding helmet mating hole, and thereby releasing the facemask clamp from the helmet.

BRIEF DESCRIPTION OF THE DRAWINGS

Figure 1:
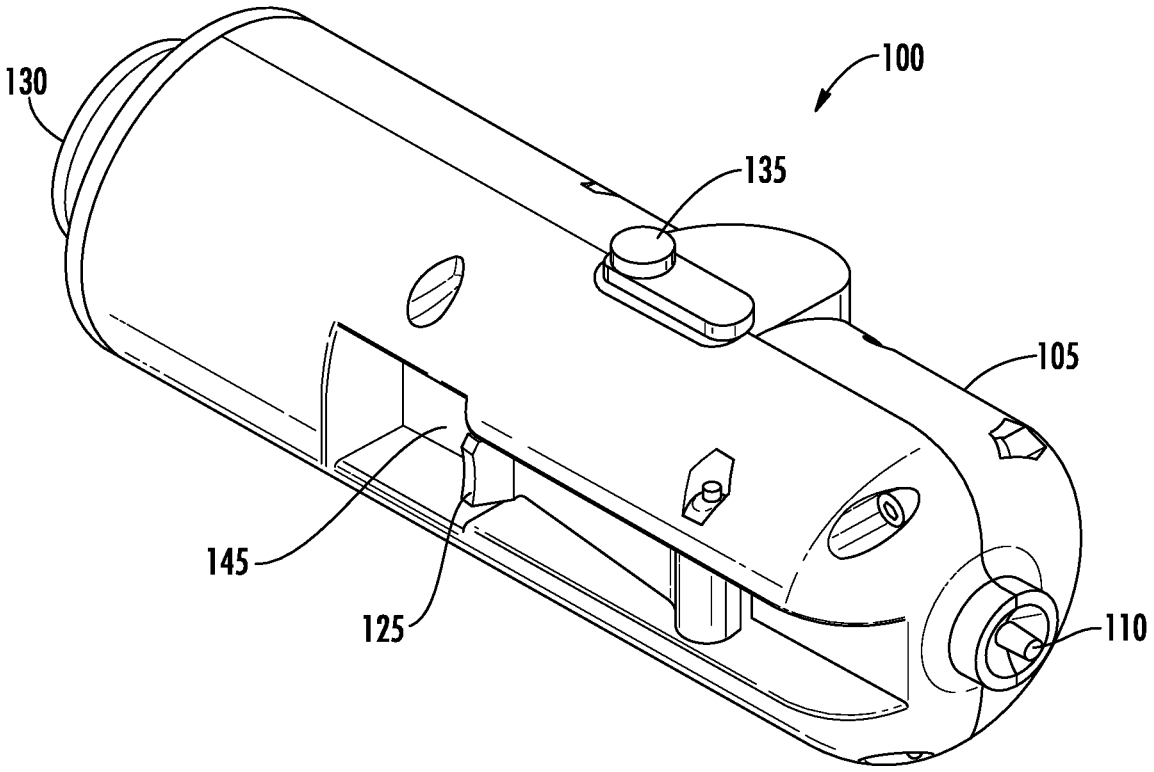

Having thus described the presently disclosed subject matter in general terms, reference will now be made to the accompanying Drawings, which are not necessarily drawn to scale, and wherein:

FIG. 1 shows a perspective view of an example of the presently disclosed helmet tool.

Figure 2:
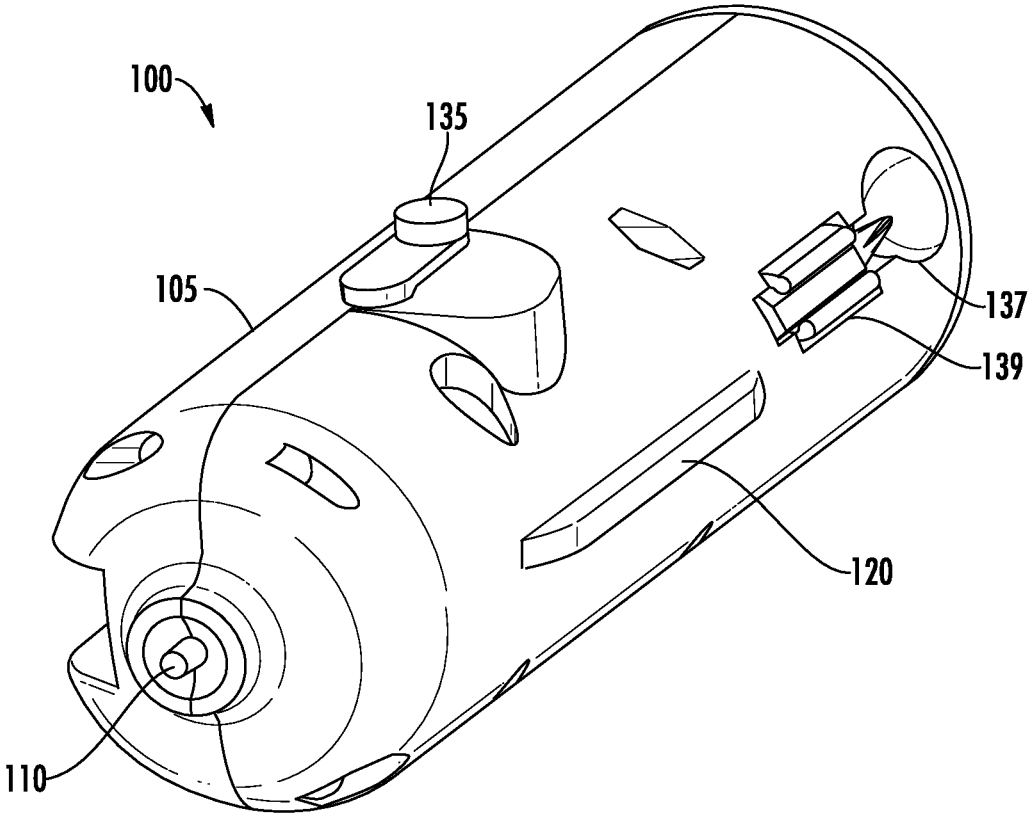

FIG. 2 shows another perspective view thereof.

Figure 3:
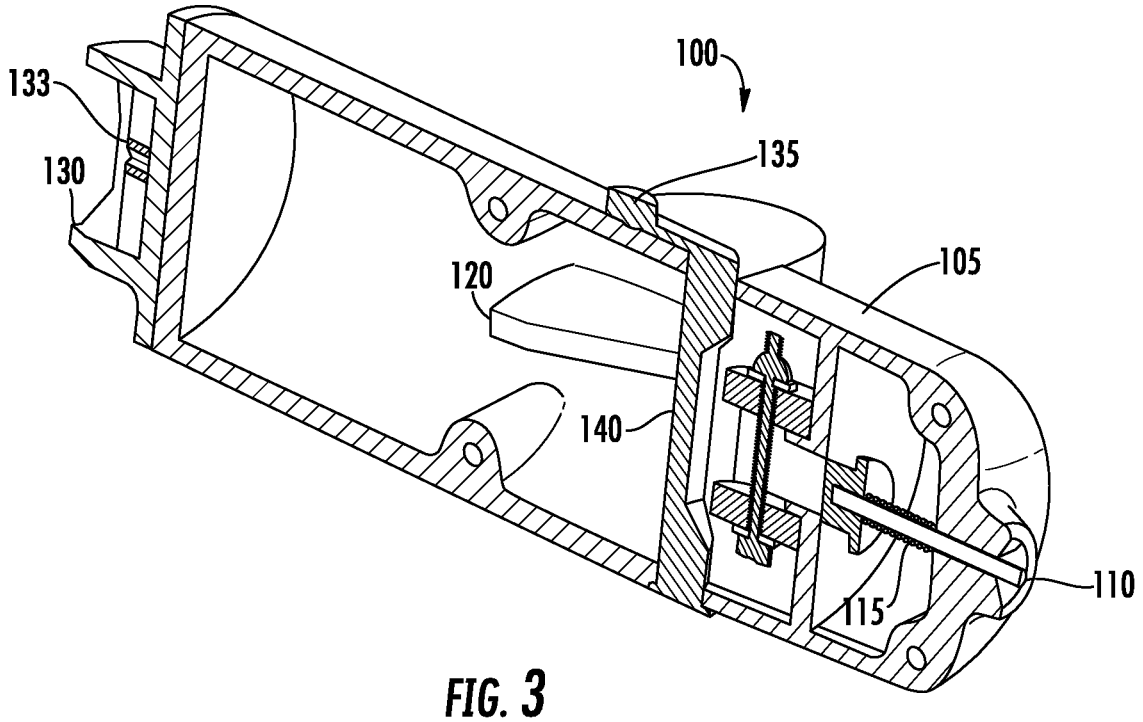

FIG. 3 shows a cross-sectional view thereof.

Figure 4:
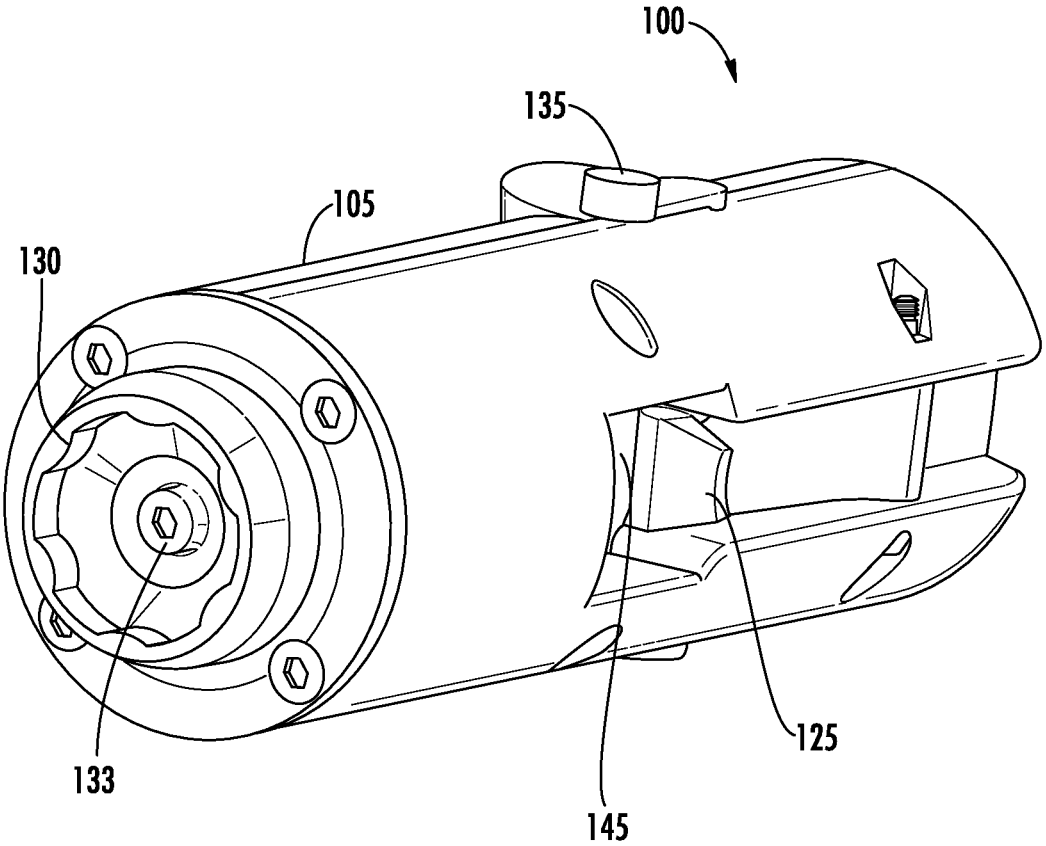

FIG. 4 shows a rear perspective view thereof.

Figure 5:
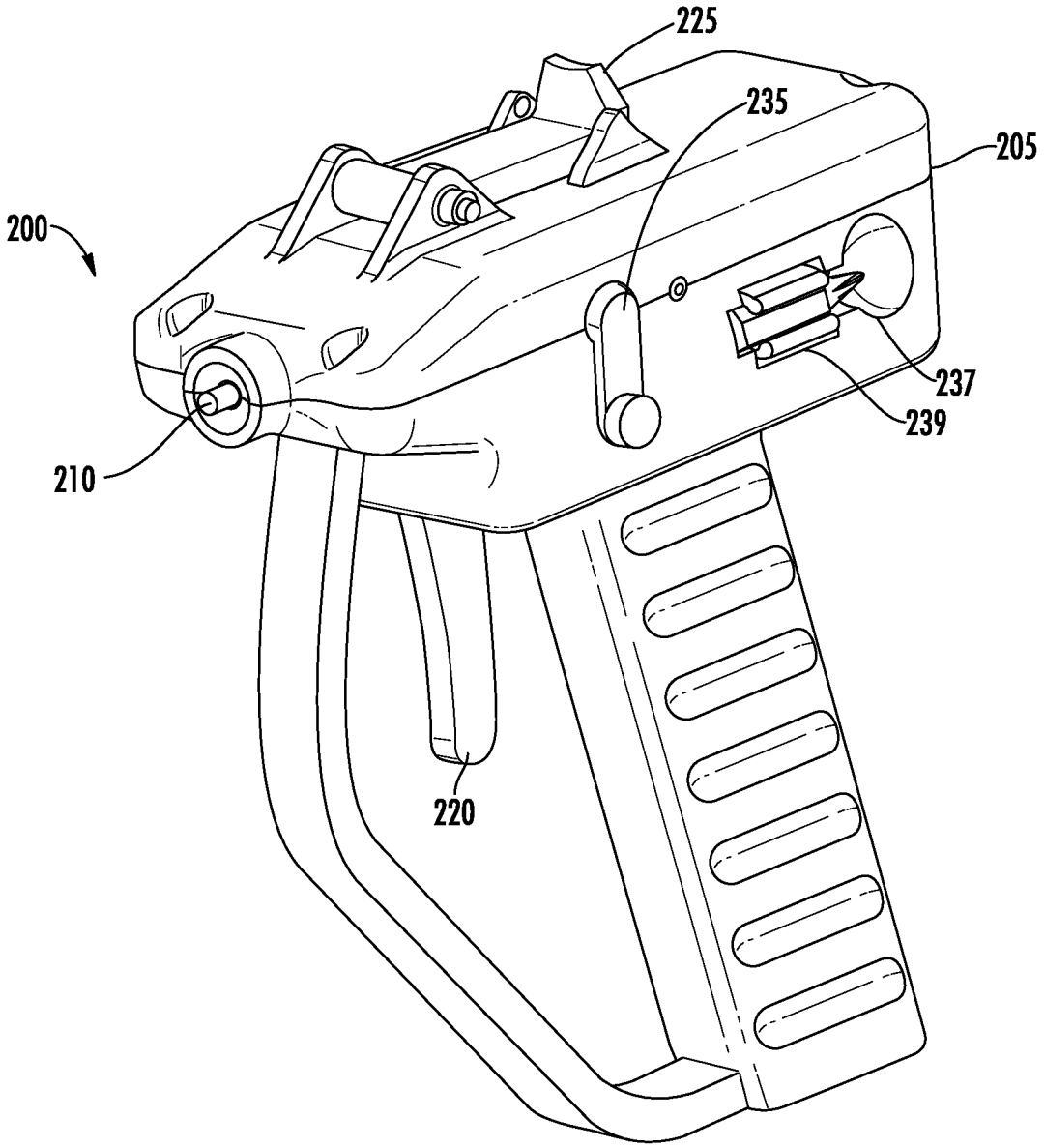

FIG. 5 shows another perspective view of another example of the presently disclosed helmet tool.

Figure 6:
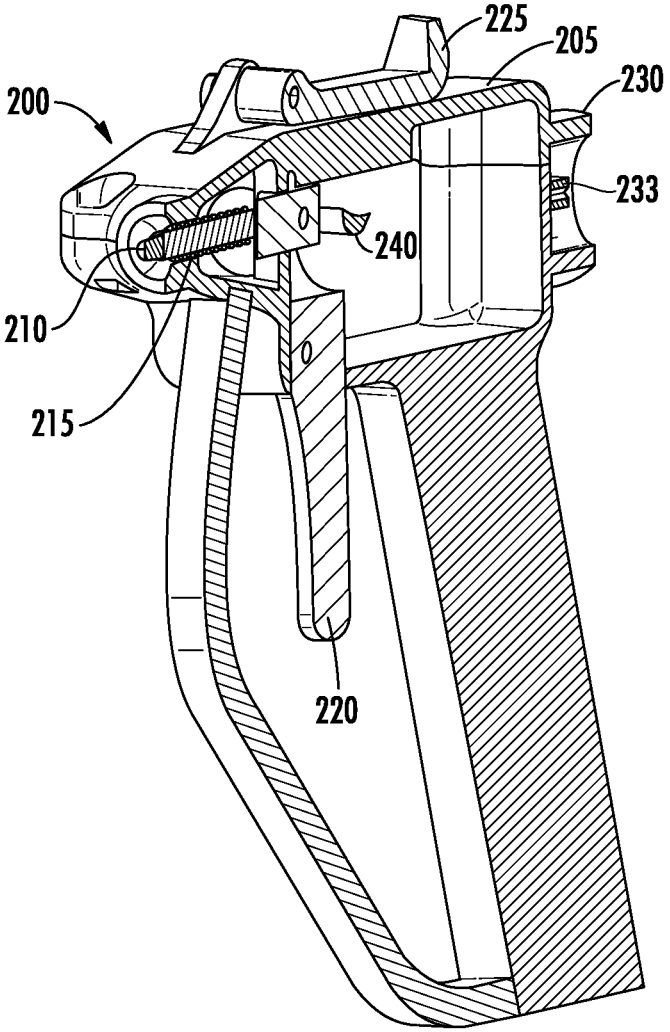

FIG. 6 shows a cross-sectional view thereof.

Figure 7A:
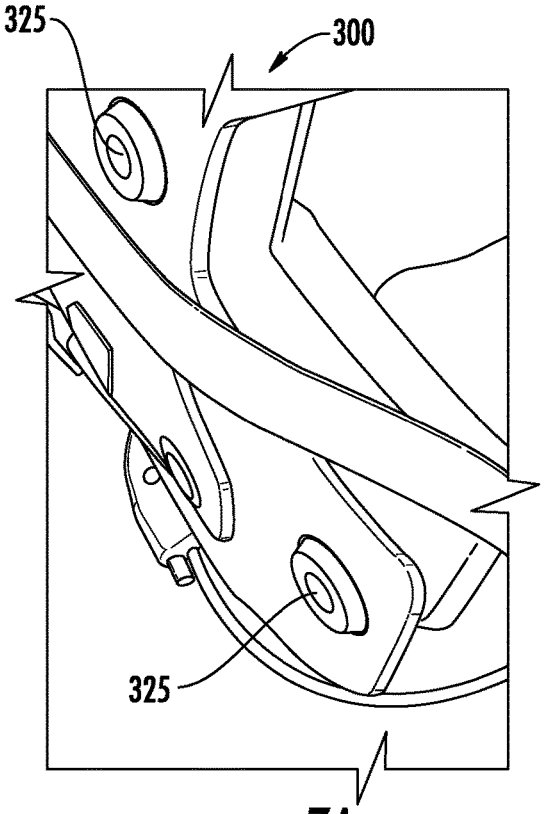

FIG. 7A shows an example of a helmet with its facemask removed.

Figure 7B:
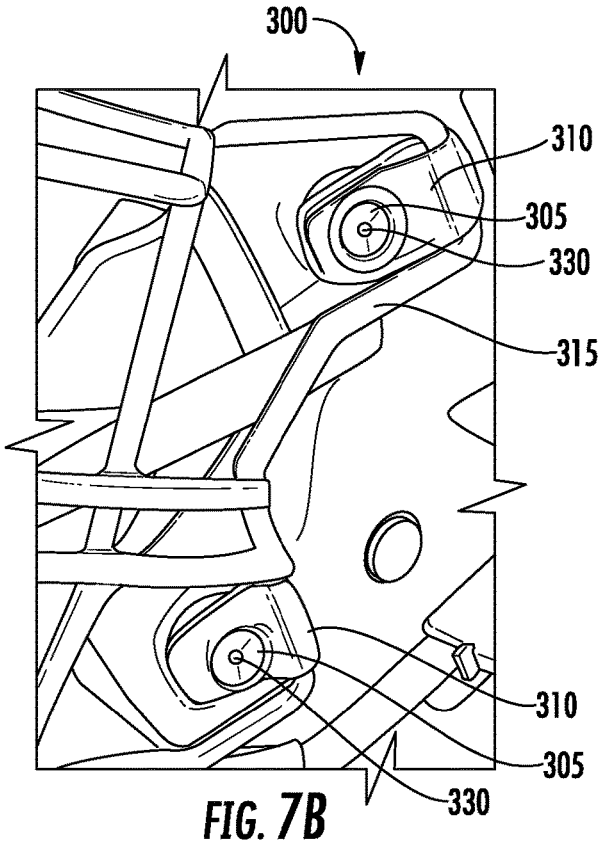

FIG. 7B shows an example of a helmet with its facemask installed.

Figure 7C:
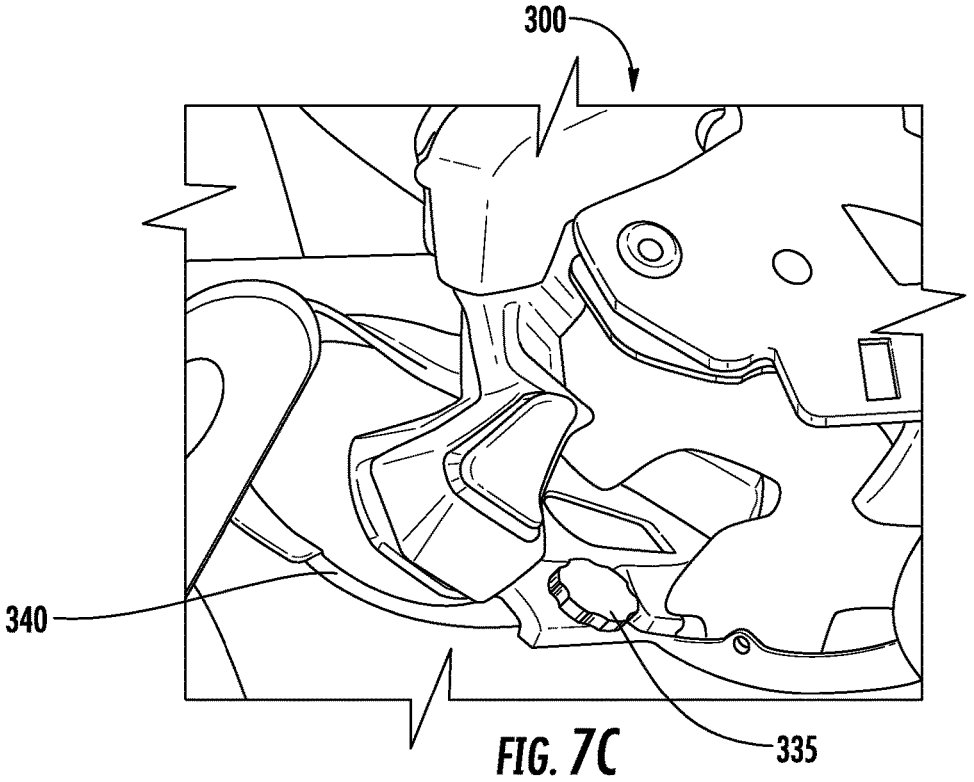

FIG. 7C shows an example of an interior of a helmet showing a chin strap nut.

Figure 8:
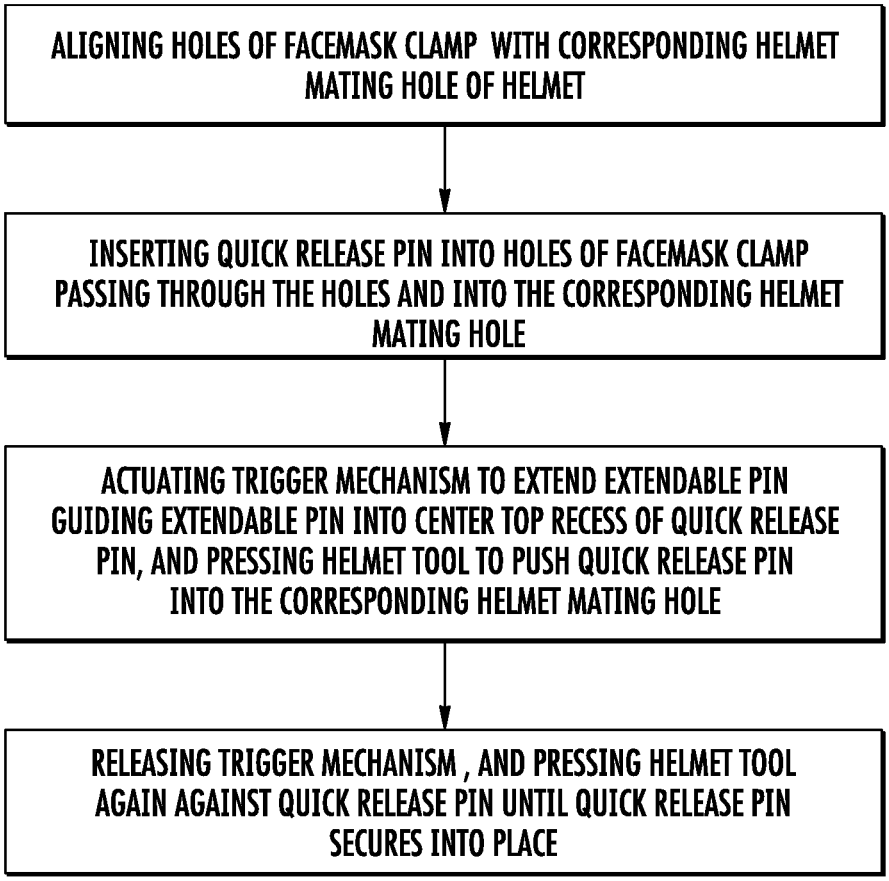

FIG. 8 illustrates a flow diagram of an example of a method for installing a facemask on a football helmet using the presently disclosed helmet tool.

Figure 9:
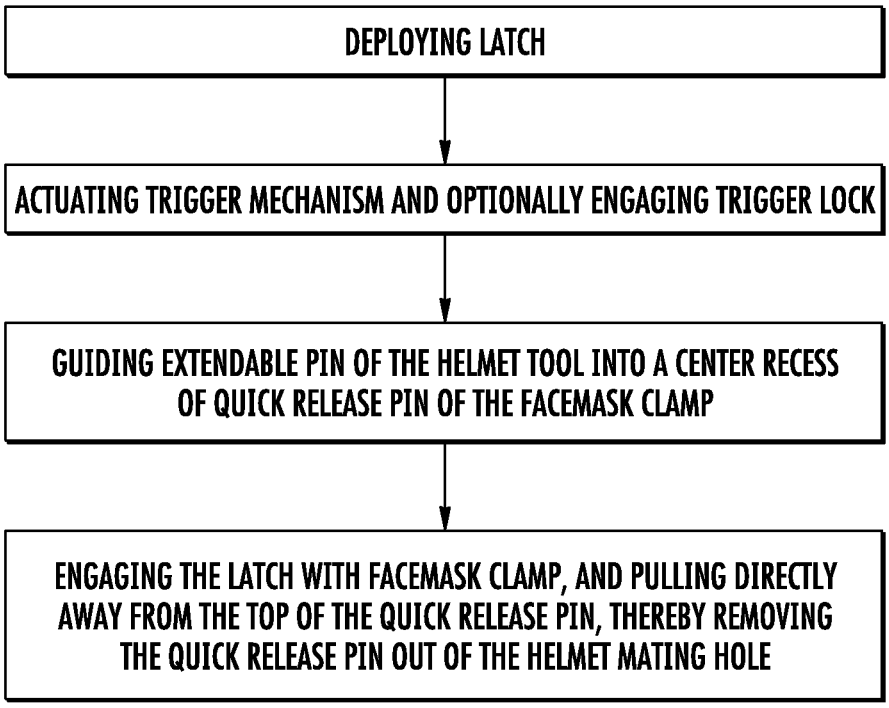

FIG. 9 illustrates a flow diagram of an example of a method for removing a facemask of a football helmet using the presently disclosed helmet tool.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

The invention provides a helmet tool for quicker and easier installation and removal of football helmet components, such as a facemask, by allowing a user to use the tool in a single orientation while installing and/or removing a facemask for example. The helmet tool may include an integral chin strap nut driver, and may also include an integrated socket and removable bit driver, providing added convenience since all operations on the helmet are contained in the single helmet tool. Existing helmet tools are typical provided as separate tools for each operation (e.g., one tool for facemask installation/removal and a separate tool for chin strap installation/removal). Further, for installation or removal of a facemask it requires multiple orientations to be employed by the user during operation of the tool.

The overall configuration of the helmet tool may take many different configurations, for example, pistol or screwdriver shaped; however, any configuration capable of housing the elements as described below and preferably fitting inside the helmet during use on the chin strap nut may alternatively be employed.

The invention will now be described with reference to FIGS. 1-9.

With reference to FIGS. 1-4, in one embodiment, helmet tool 100 may include a housing 105, extendable pin 110, a compression spring 115, a trigger mechanism 120, and a latch 125. Wherein, extendable pin 110, compression spring 115, and trigger mechanism 120 are configured together within the housing 105 such that actuation of the trigger mechanism 120 causes extendable pin 110 to one of extend from or retract into the housing 105.

Housing 105 forms the overall physical shape of the helmet tool 100 and holds the components in operational conjunction so they can adequately perform their functions. Housing 105 may be of any suitable shape, including but not limited to, generally cylindrical (screwdriver handle) shaped, or generally pistol shaped (See FIGS. 5-6). The housing 105 may further include a recess and/or holder (recess/holder 145) for latch 125. In one example, the housing 105 may be formed of two or more pieces to allow for easy assembly of components. Housing 105 may be made of plastic, metal, or any other suitable material.

Extendable pin 110 may be a steel pin about ⅛ of an inch in diameter, and may be of any suitable length as may be required by the size of the helmet tool 100. In one example, extendable pin 110 may be about 1.25 inches in length.

Compression spring 115 may be a steel compression spring, and may be of any suitable length as may be required by the size of the helmet tool 100. In one example, compression spring 115 may be about 1 inch in length when in an uncompressed state.

Trigger mechanism 120 may be a traditional gun shaped trigger, a push button, slide, fan shape fin, or any button, protrusion or mechanism suitable for a human finger to engage and actuate.

Latch 125 may be a generally "L" shaped metal or plastic object which can slide, rotate, fold, or otherwise move in and out of a stowed position from recess/holder 145 of housing 105. Latch 125 may further be adjustable and lockable in length. In one example, the longer portion of the "L" shape may be extendable and may be locked in its extended position. Latch 125 may comprise overlapping portions (not shown) that slide lengthwise relative to one another to increase or decrease the length of the longer portion of the "L" shape of the latch 125. The two overlapping portions may be locked in place once they are adjusted to a desired length. Once set to the desired length they may be locked in place using any conventional mechanism and/or technique, such as, for example, a set screw. In another example, the point at which the latch 125 connects to the housing 105 within the recess/holder 145 (pivot point of the latch 125) may be adjustable. Latch 125 may be adjustably attached to the housing 105, for example, using a slide rail, or any other suitable mechanism and/or technique. That is, latch 125 may be adjustably mounted to housing 105 within the recess/holder 145, such that the attachment point of latch 125 may be slideable forward and backwards, effectively changing its location relative to the nose (front) of the helmet tool 100. Doing so, would change the distance of the end portion (the short portion of the "L") from the nose of the helmet tool 100. In use, an adjustable length latch 125 would allow for helmet tool 100 to be used for a wider variety of helmets 300. For example, some helmets 300 may use facemask clamps 310 that may or may not use a grommet, which would change the location of the facemask clamp relative to the nose (front) of the helmet tool. Depending on whether or not the helmet 300 includes facemask clamps 310 with grommets, the latch 125 may need to be extended (or shortened) to allow the latch 125 to correctly engage with the facemask clamps 310.

Helmet tool 100 may further include a trigger lock 135 and/or a chin strap nut driver 130. Trigger lock 135 may include a bar 140 which extends into the housing 105. Bar 140 may have a changing shape around its perimeter such that as bar 140 is rotated, it either allows the full range of motion of the trigger mechanism 120 or prevents the trigger mechanism 120 from releasing once actuated, thus leaving extendable pin 110 in its extended state when the trigger mechanism 120 is released and the trigger lock 135 is engaged in a locked position. The bar 140 may extend outside at least one side of the housing 105 to provide a handle or other mechanism to allow a user the ability to set the trigger lock 135 from unlocked to locked positions and back at will. Chin strap nut driver 130 may be integral in housing 105 and may include a generally circular indentation with inset hobs around the inside perimeter configured to engage a standard chin strap nut 335 (shown in FIG. 7C).

Helmet tool 100 may further include a socket 133, such as a hex socket. Socket 133 may be disposed in about the center of the chin strap nut driver 130, or other usable location. Helmet tool 100 may further include a drive bit 137, and may also include a drive bit recess/holder 139. Drive bit recess/holder 139 may be formed in housing 105 and is configured to hold/store drive bit 137 when not in use. Drive bit 137 may be retained in the drive bit recess/holder 139 by a spring clip, retaining arms, or any other suitable mechanism or technique. Drive bit 137 may be, in one example, a ¼ inch hex Philips drive bit. Socket 133 may be adapted to receive a base end (e.g., the hex end) of drive bit 137, wherein the driver head portion (e.g., the Philips head end) of the drive bit 137, extends outward from housing 105 and is configured to engage a fastener such as a screw (e.g., a Philips head style screw). In use, some football helmets may have screws, such as, Philips head style screws, instead of quick release pins (e.g., quick release pins 305), for securing the facemask clamps (e.g., facemask clamp 310), to the helmet (e.g., helmet 300. Further, some helmets may have a combination of Philips head style screws and quick release pins (e.g., quick release pins 305). For example, a helmet may have two (2) Philips head style screws and two (2) quick release pins, securing the facemask via the facemask clamps (e.g., facemask clamp 310), to the helmet. In such examples, having socket 133 and drive bit 137 as part of the helmet tool 100 would allow a user to remove a facemask (e.g., facemask 315), having a combination of screws and quick release pins, from a helmet (e.g., helmet 300) using a single integrated tool (e.g., helmet tool 100), rather than needing multiple tools, e.g., a Philips screw driver and a separate quick release pin removal tool.

The components of helmet tool 100 may be assembled together using, for example, industry standard hardware, screws, locknuts and/or washers, welding, or other suitable hardware or assembly technique, and made of plastic, steel, or other suitable material.

With reference to FIGS. 5-6, in another embodiment, helmet tool 200 may include a housing 205, wherein housing 205 is configured in a generally pistol grip shape. Helmet tool 200 may further include extendable pin 210, a compression spring 215, a trigger mechanism 220, and a latch 225. Latch 225 may be adjustable and lockable in length in the same or similar manner as that of latch 125 described above. Extendable pin 210, compression spring 215, and trigger mechanism 220 are configured together within the housing 205 such that actuation of the trigger mechanism 220 causes extendable pin 210 to one of extend from or retract into the housing 205. Helmet tool 200 may further include a trigger lock 235 and/or a chin strap nut driver 230 that may be similar to that of chin strap nut driver 130. Helmet tool 200 may further include a socket 233, such as a hex socket. Socket 233 may be disposed in about the center of the chin strap nut driver 230. Helmet tool 200 may further include a drive bit 237, and may also include a drive bit recess/holder 239. Drive bit recess/holder 239 may be formed in housing 205 and is configured to hold/store drive bit 237 when not in use. Drive bit 237 may be retained in the drive bit recess/holder 239 by a spring clip, retaining arms, or any other suitable mechanism or technique. Socket 233 may be adapted to receive a base end (e.g., the hex end) of drive bit 237, wherein the driver head portion (e.g., the Philips head end), extends outward from housing 205, and is configured to engage a fastener such as a screw (e.g., a Philips head style screw). The components of the helmet tool 200 embodiment are configured to function substantially similar to, or the same as, those of the helmet tool 100 embodiment.

Helmet tool 100 and 200, and therefore housing 105 and 205, are preferably configured and sized such that it can fit inside a football helmet in any orientation during use of the helmet tool 100.

With reference to FIGS. 7A, 7B, and 7C, in operation, a user of helmet tool 100 pulls, presses, or otherwise actuates trigger mechanism 120 to extend extendable pin 110. When trigger mechanism 120 is released, and the trigger lock 135 is in the unlocked position, compression spring 115 causes extendable pin 110 to retract into housing 105. When extended, extendable pin 110 is configured to mate with a standard quick release pin, e.g., quick release pin 305 of a football helmet 300 (e.g., a standard RIDDELL® football helmet), to either install or remove facemask clamps 310 holding a facemask 315 to a helmet 300. When trigger lock 135 is in the unlocked position it allows pin 110 to be retracted upon a user releasing trigger mechanism 120. However, if the trigger lock 135 is in the locked position, the extendable pin 110 will not retract upon release of trigger mechanism 120.

Latch 125 is used when removing the facemask clamps 310. Latch 125 may rotate or slide out of its stowed position in recess/holder 145 of housing 105 for use. The short leg of the "L" may be inserted between or under a bottom edge portion of the facemask clamp 310 to assist the user in pulling the facemask clamp 310 away to allow removal of the facemask 315. Optionally, the length of latch 125 may be adjusted as needed to allow for the short leg of the "L" to correctly engage with the facemask clamp 310.

The chin strap nut driver 130 may be used like any typical nut driver, and may be used to facilitate installation or removal a chin strap nut 335 to allow for the installation or removal of a chin strap 340 from helmet 300. For example, chin strap nut driver 130 may be used to hold chin strap nut 335 in place while unscrewing the corresponding bolt from the opposite side, or by using chin strap nut driver 130 to drive the chin strap nut 335 and holding the corresponding bolt stationary.

In operation, to install a facemask 315 to a helmet 300 (e.g., a RIDDELL® football helmet), a user preferably aligns the holes of a facemask clamp 310 with a corresponding helmet mating hole 325 of helmet 300. The user may then insert a quick release pin 305 into the holes of facemask clamp 310, passing through the holes and into a corresponding helmet mating hole 325. With the trigger lock 135 (235) in the unlocked position, the user then actuates trigger mechanism 120 (220) to extend extendable pin 110 (210), and guides extendable pin 110 (210) into a center top recess 330 of the quick release pin 305 and presses the helmet tool 100 (200) to push the quick release pin 305 down into holes of facemask clamp 310 and the corresponding helmet mating hole 325. Once the quick release pin 305 is seated therein, the user releases the trigger mechanism 120 (retracting the extendable pin 110 (210) into the housing 105 (205)), and presses the helmet tool 100 (200) again against the quick release pin 305 until the quick release pin 305 secures (clicks) into place. The facemask clamp 310 is now installed to helmet 300. This procedure is then repeated for all remaining facemask clamps 310 on the facemask 315. Alternatively, or in combination with the quick release pins 305, drive bit 137 (237) may be removed from drive bit recess/holder 139 (239) and placed in socket 133 (233). Drive bit 137 (237), may then be used to install any facemask clamps 310 that are secured to the helmet 300 by screws rather than by quick release pins 305.

FIG. 800 illustrates a flow diagram of an example of a method 800 for installing a facemask on a football helmet using helmet tool 100. Method 800 may include, but it not limited to, the following steps. The steps would be the same using helmet tool 200, using like elements.

At a step 810, a user preferably aligns the holes of a facemask clamp 310 with a corresponding helmet mating hole 325 of helmet 300.

At a step 815, the user may then insert a quick release pin 305 into the holes of facemask clamp 310, passing through the holes and into the corresponding helmet mating hole 325.

At a step 820, with the trigger lock 135 in the unlocked position, the user may then actuate trigger mechanism 120 to extend extendable pin 110, and guide extendable pin 110 into a center top recess 330 of the quick release pin 305 and presses the helmet tool 100 to push the quick release pin 305 down into the corresponding helmet mating hole 325.

At a step 825, once the quick release pin 305 is seated, the user releases the trigger mechanism 120 (retracting the extendable pin 110 into the housing 105), and presses the helmet tool 100 again against the quick release pin 305 until the quick release pin 305 secures (clicks) into place. The facemask clamp 310 is now installed to helmet 300. This procedure is then repeated for all remaining facemask clamps 310 on the facemask 315.

Alternatively, or in combination with the quick release pin 305, drive bit 137 may be removed from drive bit recess/holder 139 and placed in socket 133. Drive bit 137, may then be used to install any facemask clamps 310 that are secured to the helmet 300 by screws rather than by quick release pins 305.

In operation, to remove a facemask 315 from a helmet 300, a user may initially rotate or slide latch 125 out of its stowed position in recess/holder 145 of housing 105 and into a deployed position. The user may then actuate trigger mechanism 120 and set the trigger lock 135 into a locked position. The user can then release the trigger mechanism 120, while the extendable pin 110 remains extended from the housing 105. The user may then guide the extendable pin 110 of the helmet tool 100 into a center top recess 330 of the quick release pin 305 on a facemask clamp 310 that is to be removed, and push the extendable pin 110 therein. The user may now engage the short leg of the "L" shaped latch 125 between or under a bottom edge of the facemask clamp 310. Optionally, the length of latch 125 may be adjusted as needed to allow for the short leg of the "L" shaped latch 125 to correctly engage with the facemask clamp 310. The user may now pull directly away from the top of the quick release pin 305, removing the quick release pin 305 out of the helmet mating hole 325, thereby releasing facemask clamp 310 from the helmet 300. The process is repeated for any remaining facemask clamps 310 that hold the facemask 315 to the helmet 300. Alternatively, or in combination with the quick release pin 305, drive bit 137 may be removed from drive bit recess/holder 139 and placed in socket 133. Drive bit 137, may then be used to remove any facemask clamps 310 that are secured to the helmet 300 by screws rather than by quick release pins 305.

FIG. 900 illustrates a flow diagram of an example of a method 900 of removing a facemask from a football helmet 300 using helmet tool 100. Method 900 may include, but it not limited to, the following steps. The steps would be the same using helmet tool 200, using like elements.

At a step 910, a user may initially rotate or slide latch 125 out of its stowed position in recess/holder 145 of housing 105 and into a deployed position. The user may optionally, adjust the length of latch 125 as needed.

At a step 915, the user may then actuate trigger mechanism 120 and set the trigger lock 135 into a locked position. The user can then release the trigger mechanism 120, while the extendable pin 110 remains extended from the housing 105.

At a step 920, the user then guides the extendable pin 110 of the helmet tool 100 into a center top recess 330 of the quick release pin 305 of a facemask clamp 310 which is to be removed, and push the extendable pin 110 therein.

At a step 925, the user may engage a short leg of latch 125 between or under a bottom edge of the facemask clamp 310, and pulls directly away from the top of the quick release pin 305, thereby removing the quick release pin 305 out of the helmet mating hole 325, thereby releasing facemask clamp 310 from the helmet 300. The process is repeated for any remaining facemask clamps 310 that hold the facemask 315 to the helmet 300.

Alternatively, or in combination with the quick release pin 305, drive bit 137 may be removed from drive bit recess/holder 139 and placed in socket 133. Drive bit 137, may then be used to remove any facemask clamps 310 that are secured to the helmet 300 by screws rather than by quick release pins 305.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A helmet tool, comprising:

a. a housing;

b. a pin at least partially disposed in the housing;

c. a trigger mechanism operatively engaged with the pin, wherein the pin and trigger mechanism are configured together within the housing such that actuation of the trigger mechanism causes the pin to one of extend from or retract into the housing; and d. a latch connected to the housing.

2. The helmet tool of claim 1 further comprising a trigger lock configured such that when engaged it locks the trigger mechanism in one of an actuated or unactuated state.

3. The helmet tool of claim 1 further comprising a compression spring operatively engaged with the pin and trigger mechanism, wherein the pin, compression spring, and trigger mechanism are configured within the housing to cause the pin to one of extend from or retract into the housing upon actuating the trigger mechanism.

4. The helmet tool of claim 3 wherein the pin, compression spring, and trigger mechanism are configured to cause the pin to extend from the housing upon actuation of the trigger mechanism and to retract into the housing when the trigger mechanism is unactuated.

5. The helmet tool of claim 3 wherein the pin, compression spring, and trigger mechanism are configured to cause the pin to retract into the housing upon actuation of the trigger mechanism and to extend from the housing when the trigger mechanism is unactuated.

6. The helmet tool of claim 1 wherein the latch is moveably connected to an exterior portion of the housing.

7. The helmet tool of claim 1 wherein the latch is substantially L shaped and is configured to engage with a facemask clamp of a helmet.

8. The helmet tool of claim 1 wherein the latch is adjustable in length.

9. The helmet tool of claim 1 wherein an end portion of the pin is configured to engage with a quick release pin of a facemask clamp of a helmet.

10. The helmet tool of claim 1 further comprising a chin strap nut driver integrated in the housing.

11. The helmet tool of claim 10 further comprising a socket formed in about a center portion of the chin strap nut driver and a drive bit removably attached to the housing, wherein a portion of the drive bit is configured to be received by the socket.

12. The helmet tool of claim 1 wherein the housing comprises one of a generally cylindrical shape or a generally pistol shape.

13. The helmet tool of claim 1 wherein the housing comprises a storage recess for the latch.

* * * * *